United States Patent [19]

Ikari et al.

[11] Patent Number: 4,793,148

[45] Date of Patent: Dec. 27, 1988

[54] AIR CONDITIONING APPARATUS

[75] Inventors: Yoshiki Ikari, Ashikaga; Masanori Akutsu, Isesaki; Wazoh Yamada, Gunma; Hideo Maeda, Ashikaga, all of Japan

[73] Assignee: Sanyo Electric Co., Ltd., Osaka, Japan

[21] Appl. No.: 188,813

[22] Filed: Apr. 29, 1988

[30] Foreign Application Priority Data

May 13, 1987 [JP] Japan ..... 62-116206

[51] Int. Cl.[4] ..... F25B 47/00

[52] U.S. Cl. ..... 62/280; 62/279

[58] Field of Search ..... 62/272, 279, 280, 281, 62/282, 285, 288, 291

[56] References Cited

U.S. PATENT DOCUMENTS 3,079,766 3/1963 Abbott et al. .

3,766,751 10/1973 Ball .

FOREIGN PATENT DOCUMENTS 53-44290 10/1978 Japan .

*Primary Examiner*—Henry A. Bennet

*Attorney, Agent, or Firm*—Wenderoth, Lind & Ponack

[57] ABSTRACT

The present invention provides an air conditioning apparatus in which a suction air stream drawn in the rotational direction of a propeller fan as it bypasses a baffle board, and a discharge air stream guided by a guide plate in the anti-rotational direction of the propeller fan toward the inner surface of the baffle board flow in the opposite directions and met each other in the air passage in a suction chamber, so that a powerful vortex of air is generated, the power of which is further increased by the curl plate extending so as to surround the center of the vortex. Therefore, a large quantity of water in the water storage recess in the upper surface of the bottom plate is lifted, and the resultant water turns into water droplets, which are then mixed in large quantities in the suction air stream entering the fan, whereby the water can be evaporated speedily.

4 Claims, 3 Drawing Sheets

AIR CONDITIONING APPARATUS

BACKGROUND OF THE INVENTION

The present invention relates to an air conditioning apparatus utilized for, for example, a room cooling and heating unit by which the condensate water is evaporated and discharged, or a humidifier by which the water is evaporated to add moisture to the air in the room.

In a conventional room cooling and heating unit, an indoor heat exchanger is used as an evaporator during a room cooling operation to produce condensate water. In order to discharge the condensate water out of the room, a slinger ring is provided on an outdoor fan unit, and the condensate water is blown by this slinger ring against the outdoor heat exchanger which is used as a condenser. However, during a room heating operation the outdoor heat exchanger is used as an evoporator, and the condensate water produced by the outdoor heat exchanger freezes on a bottom plate. This has caused the slinger ring on the outdoor fan unit to contact the resultant ice to generate sounds, and the rotation of the outdoor fan to be prevented.

In view of these facts, Japanese Utility Model Publication No. 44290/1978 and U.S. Pat. Nos. 3,766,751 and 3,079,766 disclose air conditioning units each of which is provided with a device for generating a vortex of air at the air suction side of an outdoor fan to lift the condensate water, instead of with a slinger ring.

Each of the condensate water lifting device disclosed in the above Japanese utility model publication and U.S. patents has a baffle board projecting from the lower portion of a fan orifice-carrying partition toward the air suction side of a fan, and a swirling member formed at one side of the baffle board. The recessed surface, which faces the fan, of the baffle board constitutes a low-pressure region, in which a vortex of air formed by a part of the air discharged by the fan and flowing thereinto is intensified by the swirling member so as to lift the condensate water.

In each of these structures, the air stream forming the vortex consists only of the discharge air stream flowing from the air discharge side of the fan to the low-pressure region, and, therefore, a powerful vortex cannot be obtained. Accordingly, it is difficult to lift a sufficient amount of condensate water even if the vortex is intensified by the swirling member.

SUMMARY OF THE INVENTION

As object of the present invention is to provide an air conditioning apparatus which is capable of forming a powerful vortex of air with the air stream discharged and sucked by the fan unit, and securing a sufficiently high condensate water lifting rate.

Another object of the present invention is to provide an air conditioning apparatus by which a large quantity of water in the water storage recess in an upper surface of a bottom plate is lifted, and the resultant water turns into water droplets, which are then mixed in large quantities in the suction air stream entering the fan, whereby the water can be evaporated speedily.

The present invention provides an air conditioning apparatus comprising a partition which divides a compartment in the air conditioning apparatus into an air suction chamber and an air discharge chamber and has a fan orifice formed therein, a bore provided in the partition which is away from the lowermost portion of the fan orifice in the rotational direction of the fan, and extending from the fan orifice to a bottom plate, a guide plate provided in the air discharge chamber so that the guide plate is opposed to the bore and fan, a baffle board provided in the air suction chamber so as to extend from edge portion of the bore in the anti-rotational direction of the fan with the inner surface of the baffle board facing the guide plate with the bore interposed therebetween, an air passage formed between the free end portion of the baffle board and a lower edge portion of the bore, and a curl plate provided in the portion of the air passage in which a part of the air stream discharged by the fan and then guided from the guide plate to the baffle board and the air sucked stream into the air passage before it has been sucked by the fan are swirled in combination to produce an air stream vortex.

According to the present invention, the air is sent from the air suction chamber into the air discharge chamber by the rotation of the fan. During this time, a part of the air which is about to be sucked by the fan is obstructed by the baffle board, and sucked in the rotational direction of the fan into the air passage as the air bypasses the baffle board.

On the other hand, a part of the air which has been discharged by the fan into the air discharge chamber is deflected by the guide plate toward the bore, and flows along the inner surface of the baffle board through the bore in the anti-rotational direction of the fan into the air passage.

The suction air stream sucked in the rotational direction of the fan into the air passage and the discharge air stream guided along the inner surface of the baffle board in the anti-rotational direction of the fan thus flow in the opposite directions to meet each other in the air passage, so that a more powerful vortex of air is formed. This vortex of air is further strengthened by the curl plate provided so as to surround the center of the vortex. As a result, the water in the water storage recess in the bottom plate is lifted in droplet form and sucked by the fan and dispersed into the air discharge chamber.

PREFERRED EMBODIMENT OF THE INVENTION

Figure 1:
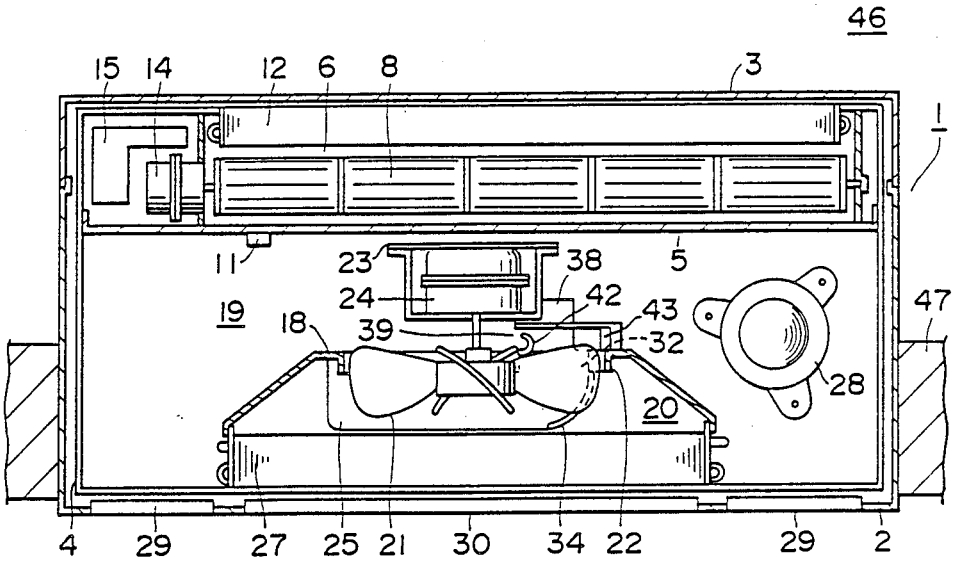
FIG. 1 is a horizontal section of an air conditioning apparatus embodying in the present invention.

A preferred embodiment of the present invention will be described with reference to FIGS. 1–5. An air conditioning apparatus 1 has a outer casing 2 and a front panel 3. The casing 2 has a botom plate 4 inserted therein slidingly along the bottom surface.

A barrier 5 is provided so that the interior of the casing 2 provided on the bottom plate 4 is divided into an indoor compartment 6 and an outdoor compartment 7. The barrier 5 has a scroll portion 9 for an indoor cross flow fan 8.

In the indoor compartment 6, a drain pan 10(FIG. 2) is provided in the upper surface of the bottom plate 4 so that a water discharge port 11 of the drain pan 10 is connected with the outdoor compartment 7, and an indoor heat exchanger 12 is provided on the drain pan, and the indoor heat exchanger 12 works as an evaporator during a room cooling operation and as a condenser during a room heating operation. The air conditioning apparatus 1 has an air filter 13 for removing dust from the indoor air flowing into the indoor heat exchanger 12, a cross-flow fan 8, a driving motor 14 for the cross-flow fan 8, and an operation controller 15 for the air conditioning apparatus. Reference numeral 16 and 17 represent a suction grill and outlet grill, respectively, which are provided at the front side of the front panel 3.

In the outdoor compartment 7, the air conditioning apparatus 1 has a partition 18 by which the interior of the outdoor compartment 7 is divided into an air suction chamber 19 and an air discharge chamber 20. An outdoor propeller fan 21 is provided in a fan orifice 22 in the partition 18 and adapted to send the outdoor air from the air suction chamber 19 to the air discharge chamber 20, and a support leg 23 is provided on the bottom plate 4 and supporting a driving motor 24 for the propeller fan 21. A water storage recess 25 is formed by sinking a part of the portion of the upper surface of the bottom plate 4 which is in the air discharge chamber 20. The water storage recess 25 is adapted to store the condensate water generated on the indoor heat exchanger 12 during a room cooling operation and flowing from the water discharge port 11 of the drain pan 10 to the water storage 25 via a water passage 26. Further, the outdoor compartment 7 has an outdoor heat exchanger 27 which is used as a condenser during a room cooling operation, a compressor 28 connected to the indoor and outdoor heat exchangers 12, 27 via refrigerant pipes, and suction grills 29 and an outlet grill 30 provided at the rear side of the casing 2.

The partition 18 has a bore 32 at the portion which is away from the lowermost portion 31 of the fan orifice 22 in the rotational direction (shown by a two-dot chain line arrow in FIG. 4) of the propeller fan 21 so that the bore 32 extends from the fan orifice 22 to the bottom plate 4. In the air discharge chamber 20, a cross-sectionally arcuate guide plate 34 is provided so that it has an inner surface 33 which is opposed to the bore 32 and propeller fan 21, and the guide plate is joined to the partition 18. In the air suction chamber 19, a baffle board 38 extends from one side edge portion 35 of the bore 32 toward the anti-rotational direction of the propeller fan 21. The baffle board 38 has an inner surface 36 opposed to the bore 32, and an upper end 37 positioned close to the propeller fan 21.

An air passage 39 is formed between a free end portion 40 of the baffle board 38 and the other side edge portion 41 of the bore 32. In the portion of the air passage 39, a semi-cylindrical curl plate 42 is provided at a position where a part of the air discharged by the propeller fan 21 and guided from the guide plate 34 to the baffle board 38 as shown by a solid-line arrow a in FIG. 5 and the air sucked into the air passage 39 as shown by a solid arrow b in FIG. 5, before it has been sucked by the propeller fan 21 are swirled to lift the water in the water storage recess 25. The semi-cylindrical curl plate 42 which has an opening 52 confronting the air suction chamber 19 extends from the partition 18 in the anti-rotational direction of the propeller fan 21.

A shield member 43 is provided extending from the baffle board 38 in the rotational direction of the propeller fan 21 along the partition 18 and has a unitary combination of a rising element 44 a part of which extends to the axis of the propeller fan 21 rather than to the fan orifice 22, and a bent element 45 positioned on the side of the outer circumference of the fan orifice 22 and bent toward the axis of the propeller fan 21.

Figure 2:
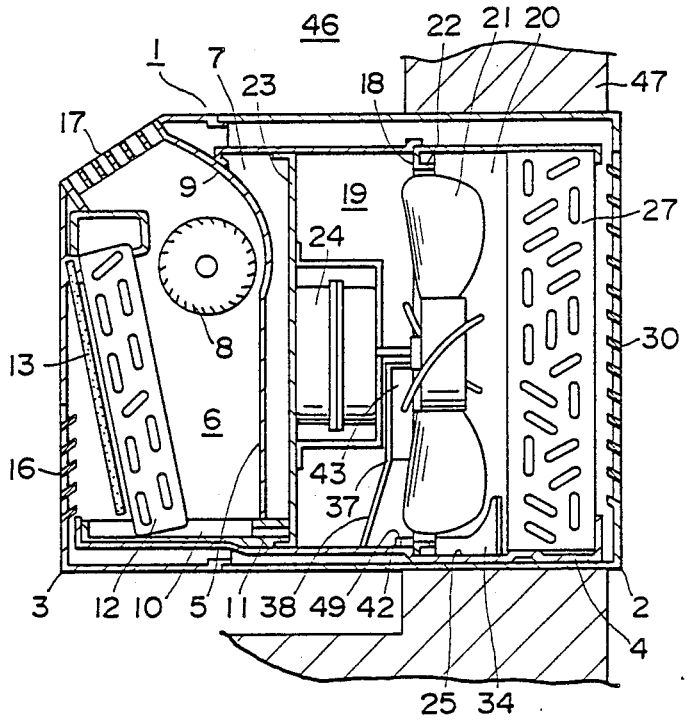
FIG. 2 is a longitudinal section of the air conditioning apparatus of the invention.
Figure 3:
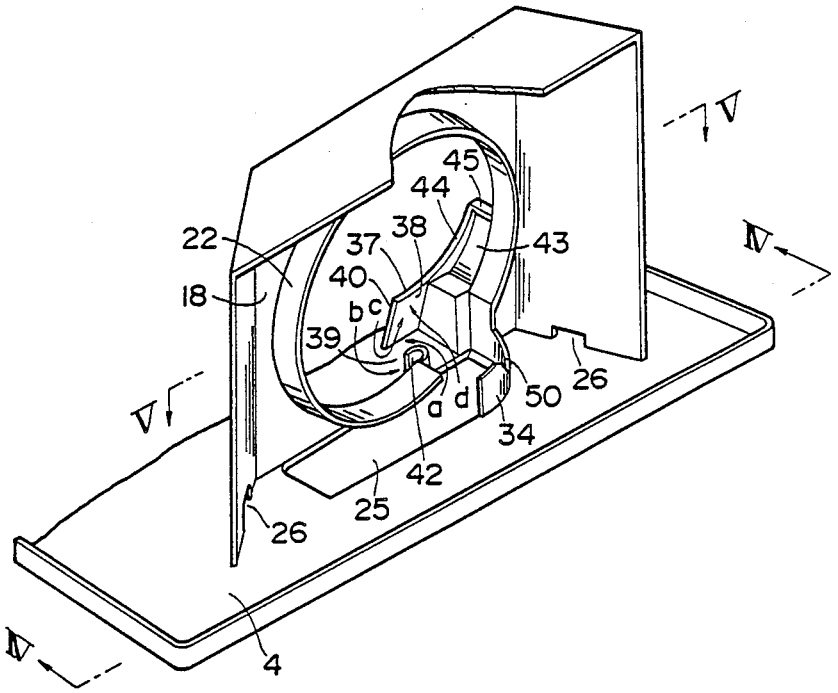
FIG. 3 is a perspective view of a principal portion of the air conditioning apparatus.
Figure 4:
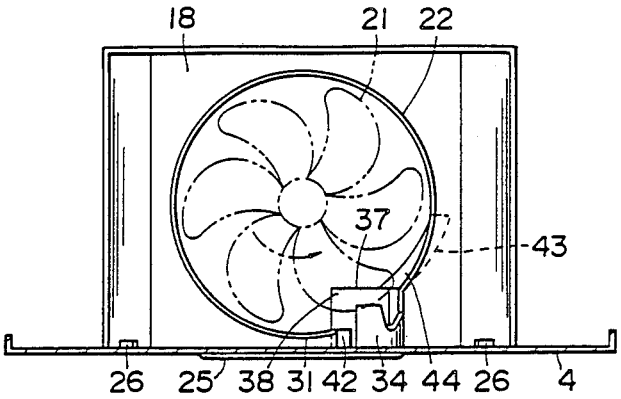
FIG. 4 is a sectional view taken along the line IV—IV in FIG. 3.

The operation of the air conditioning apparatus 1 will now be described. As shown in FIGS. 1 and 2, the air conditioning apparatus is installed through a wall 47 of a room 46. When the operation controller 15 is energized to operate the compressor 28 and motors 14, 24, the air in the room 46 is sucked from the suction grill 16 and passes through the air filter 13, and is cooled during a room cooling operation or heated during a room heating operation by the indoor heat exchanger 12. The air then crosses the interior of the cross-flow fan 8, and is discharged from the outlet grill 17 into the room 46.

The outside air is sucked from the left and right suction grills 29 into the air suction chamber 19, and a small part of the air sucked by the propeller fan 21 is then obstructed by the baffle board 38, but a major part of the air passes through the fan orifice 22 and is sent out into the air discharge chamber 20. The air is then heated during a room cooling operation or cooled during a room heating operation by the outdoor heat exchanger 27, and discharged from the central discharge grill 30 to the outside of the room. At the same time, a part of the air obstructed by the baffle board 38 is sucked itno the air passage 39 in the rotational direction of the propeller fan 21 as shown by solid line arrows b, c (FIG. 3), as the air bypasses the baffle board.

A part of the above-mentioned discharged air sent out into the air discharge chamber 20 is caught by the inner surface 33 of the guide plate 34 and deflected toward the bore 32. The air flows through the bore 32 and along the inner surface 36 of the baffle board 38 in the anti-rotational direction of the propeller fan 21 as shown by solid line arrows a, d (FIG. 3), and is guided into the air passage 39.

Figure 5:
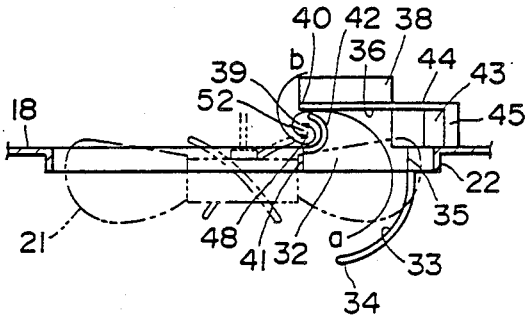
FIG. 5 is a sectional view taken along the line V—V in FIG. 3.

Thus, the suction air stream b drawn in the rotational direction of the propeller fan 21 along the bottom plate 4 into the air passage 39 and the discharge air stream a guided in the anti-rotational direction of the propeller fan 21 along the bottom plate 4 toward the inner surface 36 of the baffle board 38 flow in the opposite directions and meet each other in the air passage 39 as shown in FIG. 5, so that a more powerful vortex of air 48 is formed. The vortex is further strengthened by the curl plate 42 which surrounds the center of the vortex of air 48. Consequently, the condensate water guided from the water storage recess 25 to the bottom plate 4 in the air passage 39 through the bore 32 is drawn further to the inner side of the curl plate 42 by the vortex of air 48 and then lifted. The resultant condensate water leaves the upper end 49 of the curl plate 42 in droplet form and are sucked along with the suction air by the propeller fan 21. This water droplet-entraining suction air is dispersed into the air discharge chamber 20 and blown against the outdoor heat exchanger 27, which is used as a condenser and radiates heat during a room cooling operation. The water droplets are evaporated on this outdoor heat exchanger and discharged to the outside of the room.

During this time, the suction air sucked as shown by the solid arrows c, d flows up as it moves gradually along the inner surface 36 of the baffle board 38 toward the propeller fan 21, and it is thereafter sucked by the propeller fan 21. The condensate water flowing along the inner surface 36 from the water storage recess 25 onto the bottom plate 4 is drawn by the suction air stream c, d to flow up along the inner surface 36 of the baffle board 38 and leaves the upper end 37 of the baffle board 38 in droplet form. These water droplets are sucked along with the suction air by the propeller fan 21, and blown against the outdoor heat exchanger 27 to be evaporated. During this time, a part of the water droplets leaving the upper end 37 of the baffle board 38 and splashed in the rotational direction of the propeller fan 21 are caught by the shield member 43. The flying of the water droplets into the air suction chamber 19 is prevented by the rising element 44, and the upward movement of the water droplets is prevented by the bent element 45. The splashed water droplets are sucked along with the suction air by the propeller fan 21, and blown against the outdoor heat exchanger 27 to be evaporated.

Figure 6:
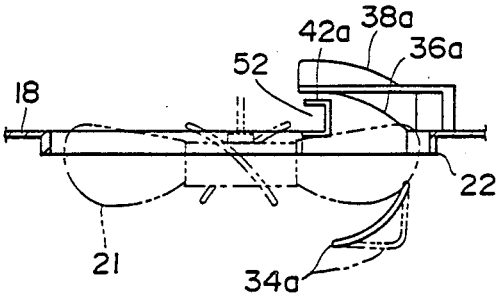
FIG. 6 is, a similar as FIG. 5, is a sectional view, showing another embodiment of the invention.

FIG. 6 shows the modification of the structure shown in FIG. 5. A guide plate 34*a* may be separated from the partition 18 by removing a smaller-height portion 50 (refer to FIGS. 3 and 4). It may also be formed in the shape of the letter "L" as shown by a two-dot chain line, though the L-shaped guide plate 34*a* increases the pressure loss of the discharged air as compared with the cross-sectionally arcuate guide plate(FIGS. 1–5).

The inner surface 36a of a baffle board 38*a* may be curved, and a bent plate 42*a* may be formed so as to have a U-shaped structure, though the U-shaped bent plate disturbs the vortex of air 48 slightly as compared with the semi-cylindrical curl plate(FIGS. 1–5).

In the above-described embodiments of the invention, it is preferable to change the shapes and positions of the guide plates 34, 34*a* and baffle boards 38, 38*a* and set the position, in which the vortex of air 48 is formed, closer to the lowermost portion 31 of the fan orifice 22. If this step is taken, the distance between the curl or bent plate 42 or 42*a* and propeller fan 21 becomes shorter, and the force by which the condensate water is lifted favorably increases. The bottom plate 4 as a whole may be used as the water storage member 25 without recessing the same.

Although the above embodiments involve only a room cooling and heating unit, the present invention can also apply to a humidifier which is provided in a compartment 7, which consists of a bottom plate 4 and a casing 2, with a partition 18 with a bore 32, a propeller fan 21, a guide plate 34, 34*a*, a baffle board 38, 38*a*, a curl or bent plate 42 or 42*a*, and gas-permeable porous plate instead of an outdoor heat exchanger 27, and which is adapted to moisten the inside air discharged by the propeller fan 21 while preventing the scattering of the water droplets.

According to the present invention, a suction air stream drawn in the rotational direction of the propeller fan as it bypasses the baffle board, and a discharge air stream guided by the guide plate in the anti-rotational direction of the fan toward the inner surface of the baffle board flow in the opposite directions and met each other in the air passage in the suction chamber, so that a powerful vortex of air is generated, the power of which is further increased by the curl plate extending so as to surround the center of the vortex. Therefore, a large quantity of water in the water storage recess in the upper surface of the bottom plate is lifted, and the resultant water turns into water droplets, which are then mixed in large quantities in the suction air stream entering the fan, whereby the water can be evaporated speedily.

What is claimed is:

1. An air conditioning apparatus comprising:

a compartment having a bottom plate and a casing, a partition dividing said compartment into an air suction chamber and an air discharge chamber, said partition having a fan orifice formed therein, a fan adapted for cooperation with said fan orifice of said partition for moving air from said air suction chamber to said air discharge chamber, a water storage means disposed on said bottom plate for collecting water.

a bore provided in said partition which is away from the lowermost portion of said fan orifice in the rotational direction of said fan, and extending from said fan orifice to said bottom plate, a guide means provided in said air discharge chamber so that said guide means is opposed to said bore and said fan, a baffle means provided in said air suction chamber so as to extend from a higher edge portion of said bore in the anti-rotational direction of said fan, said baffle means having a surface facing said guide means with said bore interposed therebetween, an air passage formed between a free end portion of said baffle means and a lower edge portion of said bore, and a curl means having an opening confronting said air suction chamber, said curl means being set in a portion of said air passage in which a part of an air stream discharged from said fan and then guided from said guide means to said baffle means and an air stream sucked into said air passage before the air stream has been sucked by said fan are swirled in combination to produce an air stream vortex.

2. An air-conditioner according to claim 1, wherein said inner surface of said guide means is made cross-sectionally arcuate.

3. An air-conditioner according to claim 1, wherein the upper end of said baffle means is close to said fan.

4. An air-conditioner according to claim 1, wherein said curl means consists of a semi-cylindrical plate extending from said partition in the anti-rotational direction of said fan.

* * * * *